US008511086B1

(12) United States Patent
Uhm et al.

(10) Patent No.: US 8,511,086 B1
(45) Date of Patent: Aug. 20, 2013

(54) SYSTEM AND METHOD FOR REDUCING COMBUSTION DYNAMICS IN A COMBUSTOR

(75) Inventors: Jong Ho Uhm, Simpsonville, SC (US); Thomas Edward Johnson, Greer, SC (US); Baifang Zuo, Simpsonville, SC (US); William David York, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/409,326

(22) Filed: Mar. 1, 2012

(51) Int. Cl.
*F02C 1/00* (2006.01)

(52) U.S. Cl.
USPC ..... 60/737

(58) Field of Classification Search
USPC ..... 60/737, 738, 740, 742, 746, 39.37; 239/132.5, 419, 419.3, 419.5, 423, 424.5, 239/427, 427.3, 427.5, 428, 430, 433, 556, 239/557
See application file for complete search history.

(56) References Cited

U.S. PATENT DOCUMENTS 3,771,500 A 11/1973 Shakiba
3,943,705 A * 3/1976 DeCorso et al. ..... 60/723
4,100,733 A * 7/1978 Striebel et al. ..... 60/39.463
4,104,873 A 8/1978 Coffinberry
4,412,414 A 11/1983 Novick et al.
4,967,561 A * 11/1990 Bruhwiler et al. ..... 60/737
5,104,310 A 4/1992 Saltin
5,205,120 A 4/1993 Obländer et al.
5,213,494 A 5/1993 Jeppesen
5,235,814 A * 8/1993 Leonard ..... 60/738
5,263,325 A * 11/1993 McVey et al. ..... 60/738
5,339,635 A * 8/1994 Iwai et al. ..... 60/733
5,341,645 A 8/1994 Ansart et al.
5,439,532 A 8/1995 Fraas
5,592,819 A 1/1997 Ansart et al.
5,707,591 A 1/1998 Semedard et al.
6,098,407 A 8/2000 Korzendorfer et al.
6,123,542 A 9/2000 Joshi et al.
6,267,585 B1 * 7/2001 Suttrop ..... 431/354
6,394,791 B2 5/2002 Smith et al.
6,438,961 B2 8/2002 Tuthill et al.
6,796,790 B2 9/2004 Venizelos et al.
6,983,600 B1 1/2006 Dinu et al.
7,003,958 B2 2/2006 Dinu et al.
7,007,478 B2 3/2006 Dinu
7,617,682 B2 * 11/2009 Bruck ..... 60/723
7,631,499 B2 12/2009 Bland
7,752,850 B2 7/2010 Laster et al.
8,157,189 B2 * 4/2012 Johnson et al. ..... 239/132.5
8,261,555 B2 * 9/2012 Uhm et al. ..... 60/746

(Continued)

*Primary Examiner* — Phutthiwat Wongwian
(74) *Attorney, Agent, or Firm* — Dority & Manning, PA

(57) ABSTRACT

A system for reducing combustion dynamics in a combustor includes an end cap having an upstream surface axially separated from a downstream surface, and tube bundles extend through the end cap. A diluent supply in fluid communication with the end cap provides diluent flow to the end cap. Diluent distributors circumferentially arranged inside at least one tube bundle extend downstream from the downstream surface and provide fluid communication for the diluent flow through the end cap. A method for reducing combustion dynamics in a combustor includes flowing fuel through tube bundles that extend axially through an end cap, flowing a diluent through diluent distributors into a combustion chamber, wherein the diluent distributors are circumferentially arranged inside at least one tube bundle and each diluent distributor extends downstream from the end cap, and forming a diluent barrier in the combustion chamber between at least one pair of adjacent tube bundles.

20 Claims, 8 Drawing Sheets

(56) References Cited

U.S. PATENT DOCUMENTS

| | | | | |
|---|---|---|---|---|
| 8,276,385 | B2 * | 10/2012 | Zuo et al. | 60/737 |
| 2004/0216463 | A1 | 11/2004 | Harris | |
| 2008/0016876 | A1 | 1/2008 | Colibaba-Evulet et al. | |
| 2008/0304958 | A1 | 12/2008 | Norris et al. | |
| 2009/0297996 | A1 | 12/2009 | Vatsky et al. | |
| 2010/0008179 | A1 | 1/2010 | Lacy et al. | |
| 2010/0024426 | A1 | 2/2010 | Varatharajan et al. | |
| 2010/0031662 | A1 | 2/2010 | Zuo | |
| 2010/0060391 | A1 | 3/2010 | Ristola et al. | |
| 2010/0084490 | A1 | 4/2010 | Zuo et al. | |
| 2010/0089367 | A1 | 4/2010 | Johnson et al. | |
| 2010/0095676 | A1 | 4/2010 | Uhm et al. | |
| 2010/0139280 | A1 | 6/2010 | Lacy et al. | |
| 2010/0186413 | A1 | 7/2010 | Lacy et al. | |
| 2010/0192581 | A1 | 8/2010 | Ziminsky et al. | |
| 2010/0218501 | A1 | 9/2010 | York et al. | |
| 2010/0236247 | A1 | 9/2010 | Davis, Jr. et al. | |
| 2010/0252652 | A1 | 10/2010 | Johnson et al. | |
| 2010/0287942 | A1 | 11/2010 | Zuo et al. | |
| 2011/0016871 | A1 | 1/2011 | Kraemer et al. | |
| 2011/0072824 | A1 | 3/2011 | Zuo et al. | |
| 2011/0073684 | A1 | 3/2011 | Johnson et al. | |
| 2011/0083439 | A1 | 4/2011 | Zuo et al. | |
| 2011/0089266 | A1 | 4/2011 | Stoia et al. | |
| 2012/0055167 | A1 * | 3/2012 | Johnson et al. | 60/776 |
| 2012/0180487 | A1 * | 7/2012 | Uhm et al. | 60/737 |

* cited by examiner

SYSTEM AND METHOD FOR REDUCING COMBUSTION DYNAMICS IN A COMBUSTOR

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present invention generally involves a system and method for reducing combustion dynamics in a combustor.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid exits the compressor and flows through one or more nozzles into a combustion chamber in each combustor where the compressed working fluid mixes with fuel and ignites to generate combustion gases having a high temperature and pressure. The combustion gases expand in the turbine to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by the nozzles, possibly causing severe damage to the nozzles in a relatively short amount of time. In addition, higher combustion gas temperatures generally increase the disassociation rate of diatomic nitrogen, increasing the production of nitrogen oxides ($NO_x$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, a plurality of premixer tubes may be radially arranged in an end cap to provide fluid communication for the working fluid and fuel through the end cap and into the combustion chamber. Although effective at enabling higher operating temperatures while protecting against flashback or flame holding and controlling undesirable emissions, some fuels and operating conditions produce very high frequencies with high hydrogen fuel composition in the combustor. Increased vibrations in the combustor associated with high frequencies may reduce the useful life of one or more combustor components. Alternately, or in addition, high frequencies of combustion dynamics may produce pressure pulses inside the premixer tubes and/or combustion chamber that affect the stability of the combustion flame, reduce the design margins for flashback or flame holding, and/or increase undesirable emissions. Therefore, a system and method that reduces resonant frequencies in the combustor would be useful to enhancing the thermodynamic efficiency of the combustor, protecting the combustor from catastrophic damage, and/or reducing undesirable emissions over a wide range of combustor operating levels.

BRIEF DESCRIPTION OF THE INVENTION

Aspects and advantages of the invention are set forth below in the following description, or may be obvious from the description, or may be learned through practice of the invention.

One embodiment of the present invention is a system for reducing combustion dynamics in a combustor. The system includes an end cap that extends radially across at least a portion of the combustor, wherein the end cap comprises an upstream surface axially separated from a downstream surface. A plurality of tube bundles extends from the upstream surface through the downstream surface of the end cap, wherein each tube bundle provides fluid communication through the end cap. A diluent supply in fluid communication with the end cap provides diluent flow to the end cap. A plurality of first diluent distributors are circumferentially arranged inside at least one tube bundle, wherein each first diluent distributor extends downstream from the downstream surface and provides fluid communication for the diluent flow through the downstream surface of the end cap.

Another embodiment of the present invention is a system for reducing combustion dynamics in a combustor that includes an end cap that extends radially across at least a portion of the combustor, wherein the end cap comprises an upstream surface axially separated from a downstream surface. A plurality of tube bundles extends from the upstream surface through the downstream surface of the end cap, wherein each tube bundle provides fluid communication through the end cap. A diluent supply in fluid communication with the end cap provides diluent flow to the end cap. A plurality of diluent ports circumferentially arranged inside at least one tube bundle provides fluid communication for the diluent flow through the downstream surface of the end cap. A plurality of first diluent distributors are in fluid communication with at least some of the diluent ports, wherein each first diluent distributor extends downstream from the downstream surface.

The present invention may also include a method for reducing combustion dynamics in a combustor. The method includes flowing a fuel through a plurality of tube bundles that extend axially through an end cap that extends radially across at least a portion of the combustor. The method further includes flowing a diluent through a plurality of diluent distributors into a combustion chamber downstream from the end cap, wherein the plurality of diluent distributors are circumferentially arranged inside at least one tube bundle and each diluent distributor extends downstream from the end cap, and forming a diluent barrier in the combustion chamber between at least one pair of adjacent tube bundles.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
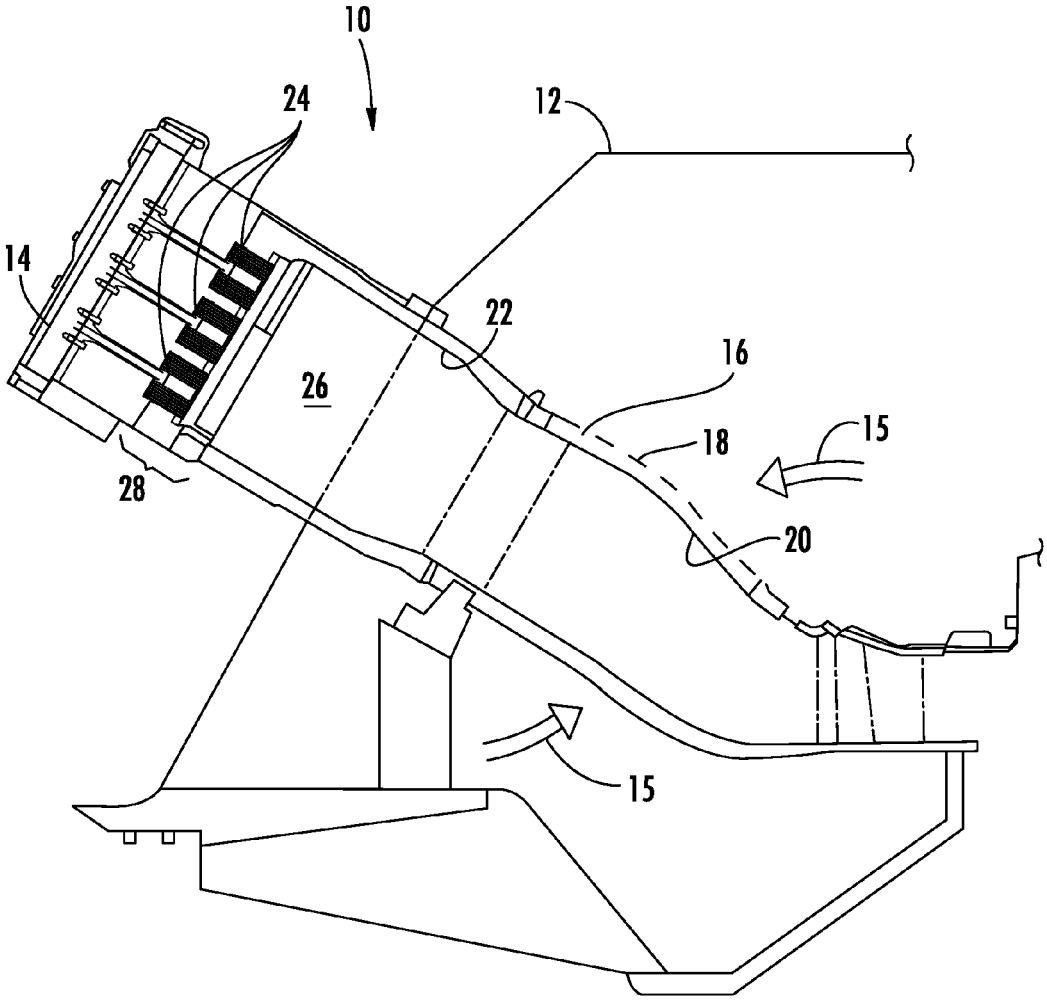
FIG. 1 is a simplified cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for reducing combustion dynamics in a combustor. The system and method generally include a plurality of tube bundles radially arranged in an end cap. The tube bundles supply a mixture of fuel and working fluid to a combustion chamber downstream from the end cap. A diluent supply in fluid communication with the end cap provides diluent flow to the end cap. A plurality of diluent distributors circumferentially arranged inside at least one tube bundle and extending downstream from the end cap provides fluid communication for the diluent flow through the end cap. The diluent distributors thus produce a diluent barrier between at least one pair of adjacent tube bundles to decouple flame interaction between the adjacent tube bundles and thus reduce the combustion dynamics in the combustor. Although exemplary embodiments of the present invention will be described generally in the context of a combustor incorporated into a gas turbine, one of ordinary skill in the art will readily appreciate that embodiments of the present invention may be applied to any combustor and are not limited to a gas turbine combustor unless specifically recited in the claims.

FIG. 1 shows a simplified cross-section of an exemplary combustor 10, such as would be included in a gas turbine, according to one embodiment of the present invention. A casing 12 and end cover 14 may surround the combustor 10 to contain a working fluid 15 flowing to the combustor 10. The working fluid 15 may pass through flow holes 16 in an impingement sleeve 18 to flow along the outside of a transition piece 20 and liner 22 to provide convective cooling to the transition piece 20 and liner 22. When the working fluid 15 reaches the end cover 14, the working fluid 15 reverses direction to flow through a plurality of tube bundles 24 into a combustion chamber 26.

Figure 2:
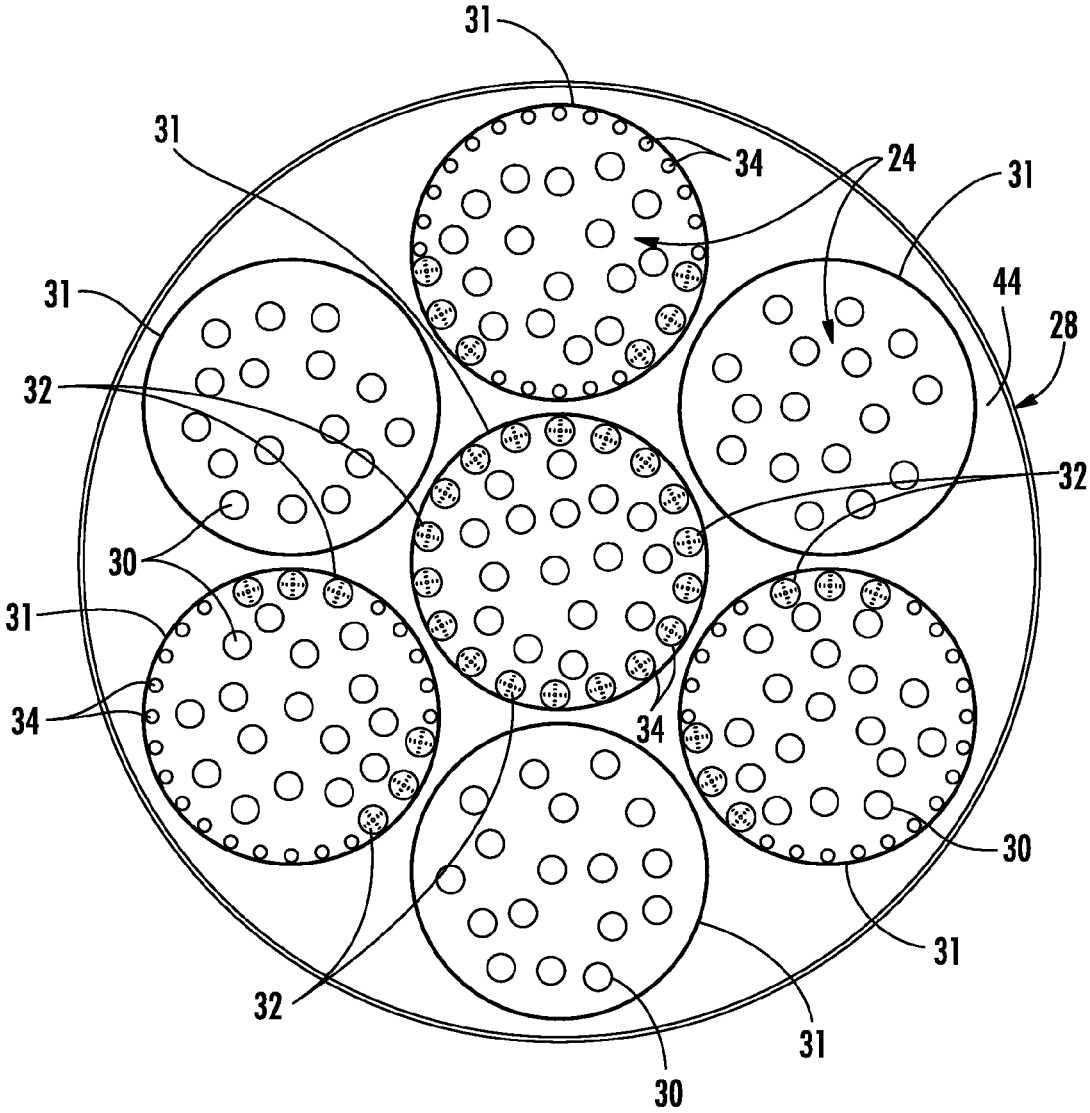
FIG. 2 is an upstream axial view of the end cap shown in FIG. 1 according to a first embodiment of the present invention.
Figure 3:
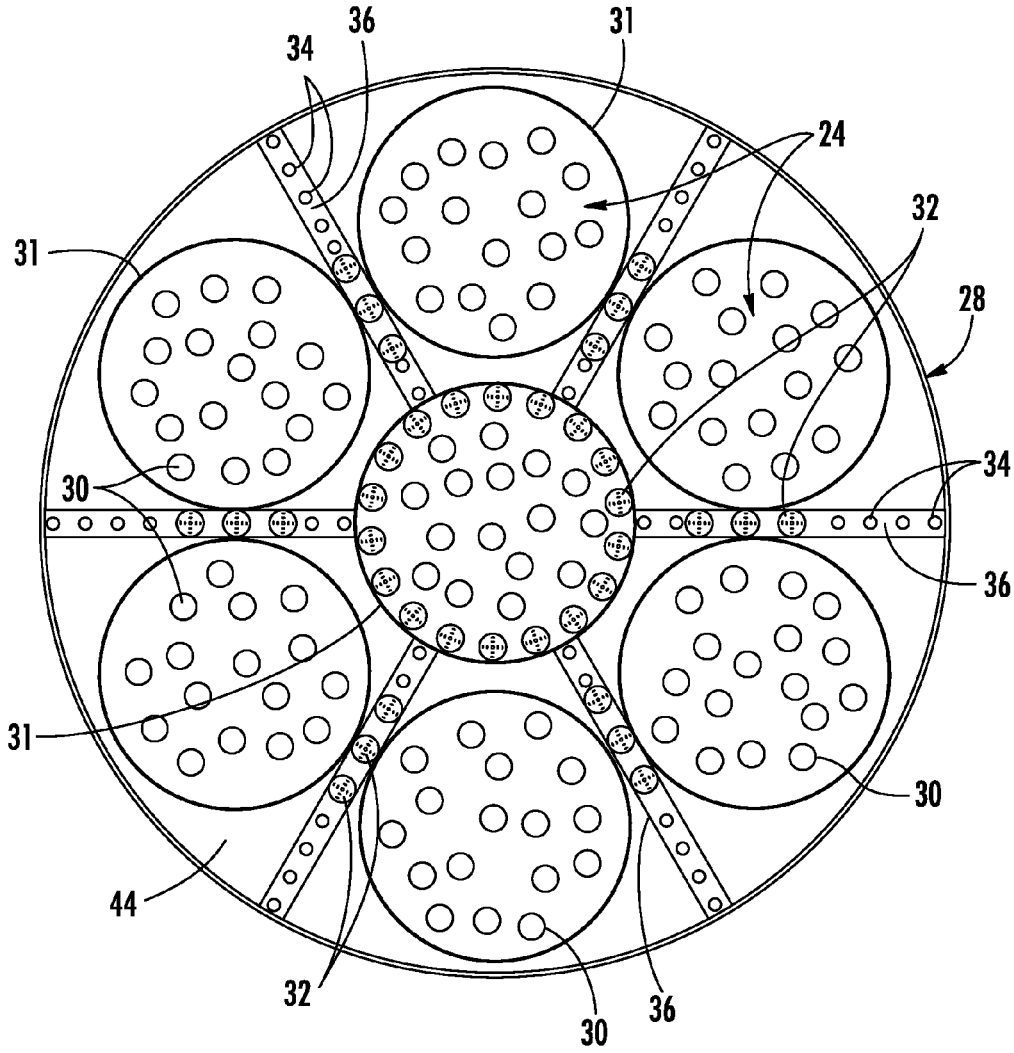
FIG. 3 is an upstream axial view of the end cap shown in FIG. 1 according to a second embodiment of the present invention.
Figure 4:
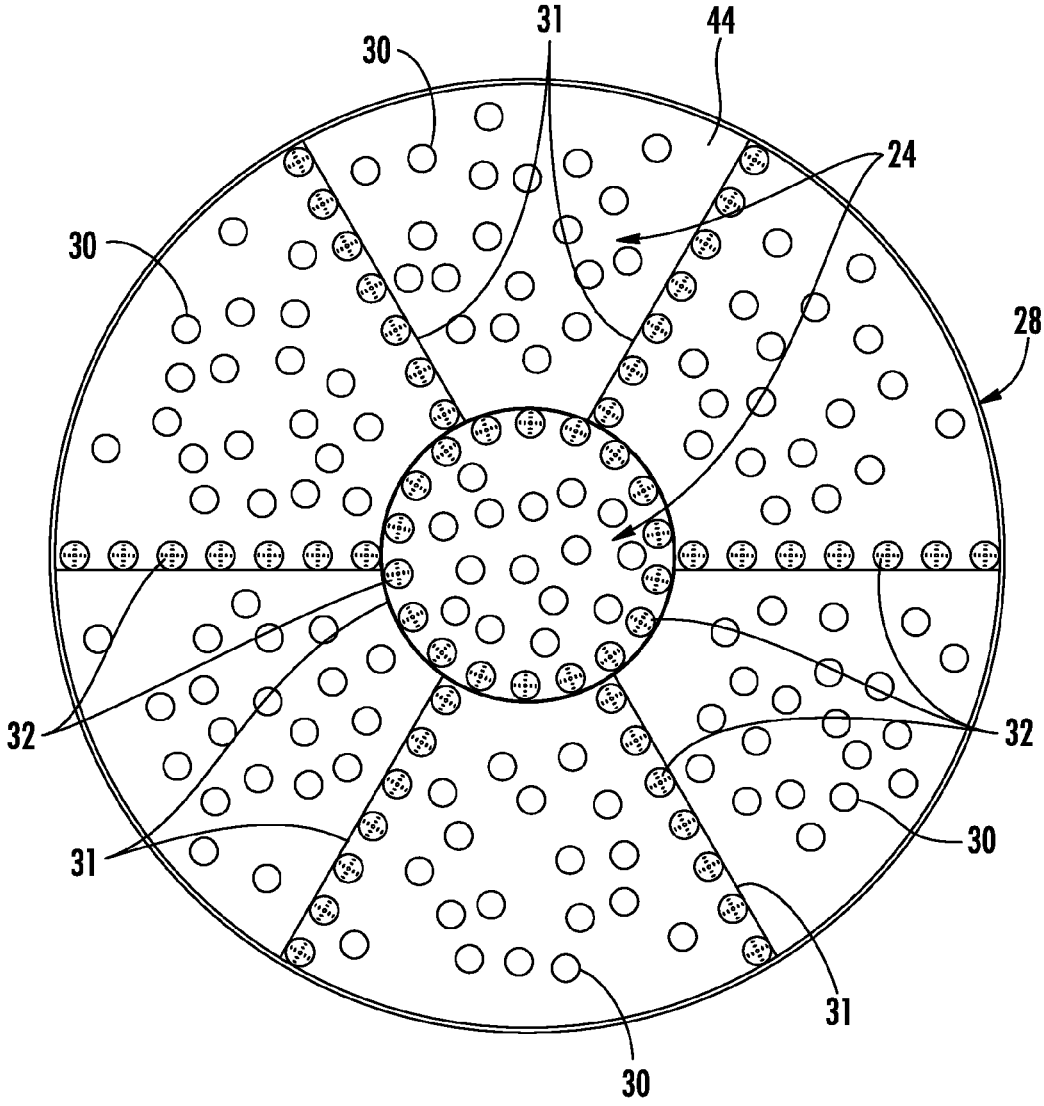
FIG. 4 is an upstream axial view of the end cap shown in FIG. 1 according to a third embodiment of the present invention.
Figure 5:
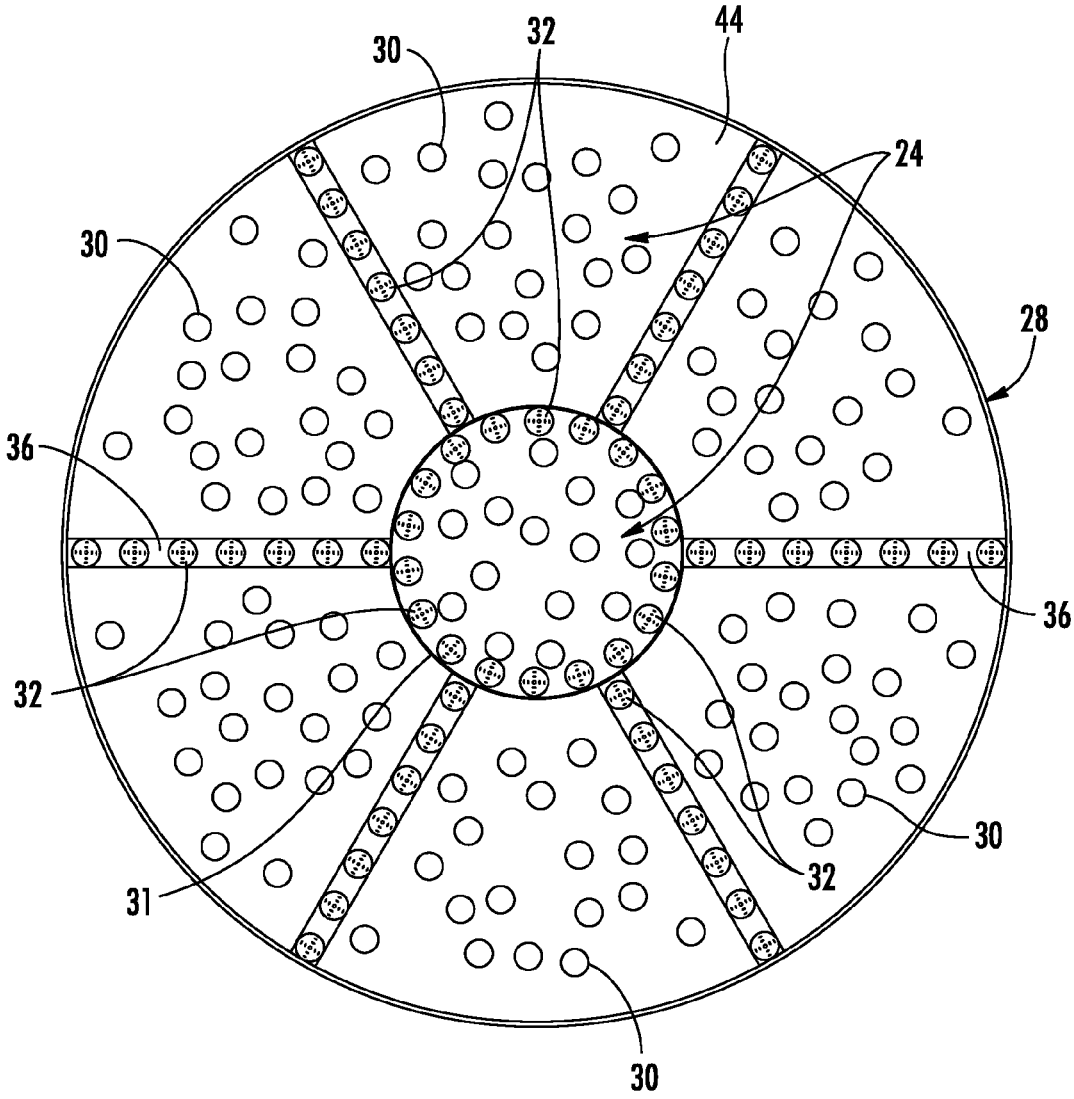
FIG. 5 is an upstream axial view of the end cap shown in FIG. 1 according to a fourth embodiment of the present invention.

The tube bundles 24 are radially arranged in different shapes, numbers, and sizes in an end cap 28 upstream from the combustion chamber 26, and FIGS. 2-5 provide upstream views of exemplary arrangements of the tube bundles 24 in the end cap 28 within the scope of the present invention. As shown in FIGS. 2 and 3, for example, the tube bundles 24 may be radially arranged across the end cap 28 in circular groups of premixer tubes 30 enclosed by outer shrouds 31, with six tube bundles 24 surrounding one tube bundle 24. Alternately, as shown in FIGS. 4 and 5, the tube bundles 24 may be arranged as a circular group of premixer tubes 30 surrounded by the outer shroud 31 surrounded by a series of pie-shaped groups of premixer tubes 30. In FIG. 4, alternating pie-shaped groups of premixer tubes 30 are at least partially enclosed by the outer shroud 31. One of ordinary skill in the art will readily appreciate multiple possible combinations of shapes, numbers, and sizes of the tube bundles 24, and the present invention is not limited to any particular arrangement of tube bundles 24 unless specifically recited in the claims.

In each exemplary arrangement shown in FIGS. 2-5, the flow of fuel and/or working fluid 15 through the premixer tubes 30 and/or tube bundles 24 may produce undesirable combustion dynamics in the combustion chamber 26, particularly when the fuel and/or working fluid 15 flow is approximately equal between each tube bundle 24. As a result, various embodiments of the present invention include one or more features to decouple the combustion flame interaction between the adjacent tube bundles 24 and thus reduce the combustion dynamics in the combustor 10. The features are generally arranged inside and/or between one or more tube bundles 24 and define a structural and/or a fluid barrier between one or more pairs of adjacent tube bundles 24 that separates the adjacent tube bundles 24. In this manner, the structural and/or fluid barrier prevents interaction between the combustion flames produced by the adjacent tube bundles 24 to reduce the undesirable combustion dynamics in the combustion chamber 26.

For example, in the particular tube bundle 24 arrangements shown in FIGS. 2-5, a plurality of diluent distributors 32 may be circumferentially arranged inside the center tube bundle 24. Each diluent distributor 32 may extend downstream from the end cap 28 to create a structural barrier inside or around the center tube bundle 24. In addition, a diluent may flow through the end cap 28 and out of the diluent distributors 32 to create a fluid barrier in the combustion chamber 26 that separates the center tube bundle 24 from adjacent tube bundles radially arranged in the end cap 28. In this manner, the diluent distributors 32 and the diluent flow through the diluent distributors 32 may sufficiently decouple any combustion flame interaction between the center tube bundle 24 and the other tube bundles 24 radially arranged in the end cap 28.

Alternately, or in addition, the diluent distributors 32 may be arranged inside or between one or more of the tube bundles 24 radially arranged in the end cap 28 to provide structural and/or fluid barriers between adjacent tube bundles 24. In the particular embodiments shown in FIGS. 2 and 4, the tube bundles 24 radially arranged in the end cap 28 include a plurality of diluent ports 34 circumferentially arranged inside alternating tube bundles 24. Alternately, as shown in the particular embodiments illustrated in FIGS. 3 and 5, the end cap 28 may include one or more dividers 36 between the tube bundles 24 radially arranged in the end cap 28. Each divider 36 may extend axially through the end cap 28 to separate adjacent tube bundles 24, and diluent ports 34 may provide fluid communication for the diluent to flow out of the dividers 36 between the adjacent tube bundles 24. In this manner, the diluent flow through the diluent ports 34 may create a fluid barrier in the combustion chamber 26 that separates the adjacent tube bundles 24 radially arranged in the end cap 28. In addition, the diluent distributors 32 may be in fluid communication with one or more of the diluent ports 34 to create a structural barrier between the adjacent tube bundles 24 radially arranged in the end cap 28. For example, in the particular embodiments shown in FIGS. 2 and 3, the diluent distributors 32 may only be coincident with the diluent ports 34 that are directly adjacent to or between the adjacent tube bundles 24. Alternately, as shown in the particular embodiments illustrated in FIGS. 4 and 5, the diluent distributors 32 may be coincident with each diluent port 34 adjacent to or between the adjacent tube bundles 24.

Figure 6:
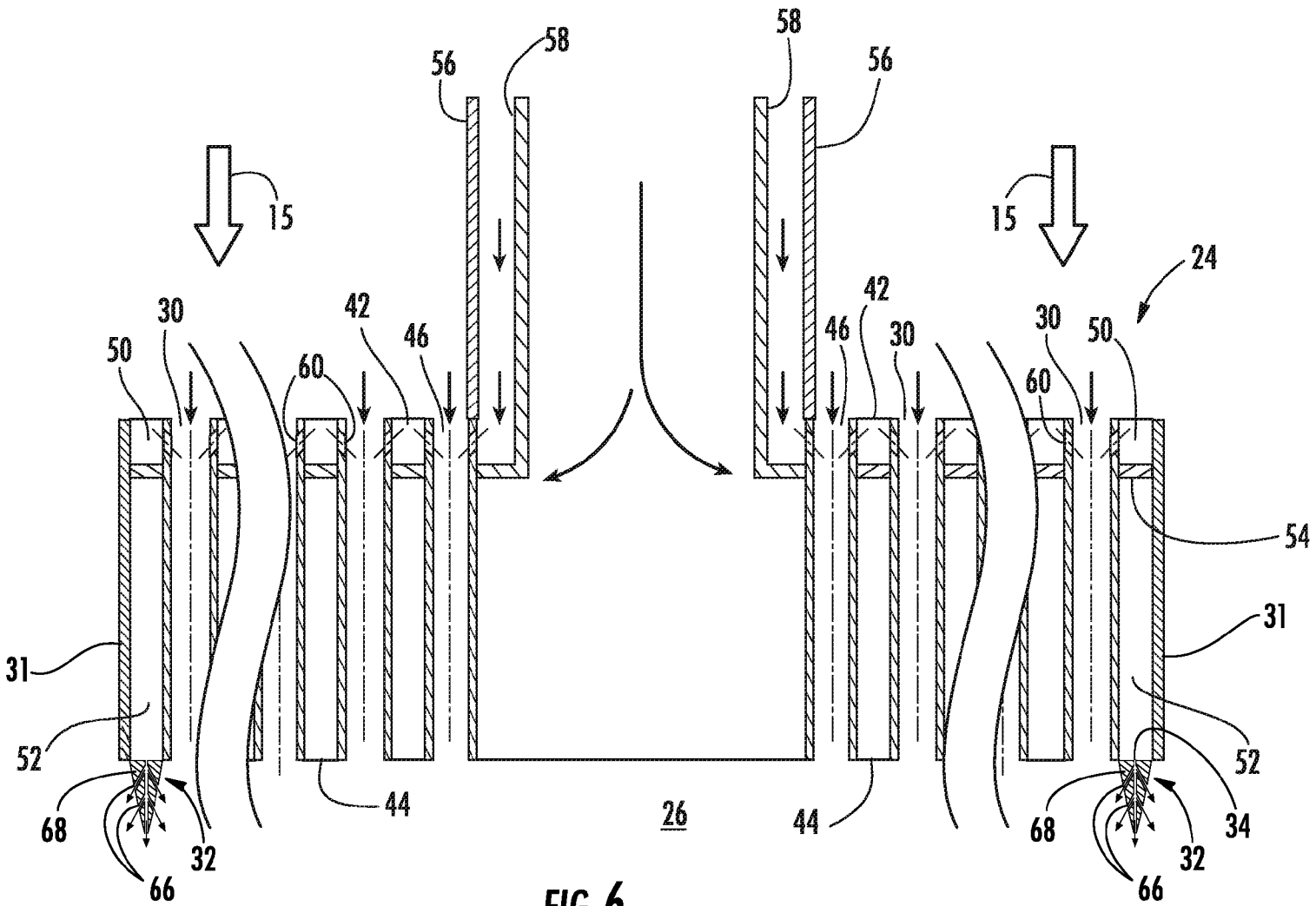
FIG. 6 is an enlarged cross-section view of a tube bundle shown in FIG. 1 according to an embodiment of the present invention.

FIG. 6 provides an enlarged cross-section view of an exemplary tube bundle 24 such as is shown in FIG. 1 and the center of FIGS. 2-5 according to a first embodiment of the present invention. As shown, the tube bundle 24 generally includes an upstream surface 42 axially separated from a downstream surface 44. Each premixer tube 30 includes a tube inlet 46 proximate to the upstream surface 42 and extends through the downstream surface 44 to provide fluid communication for the working fluid 15 to flow through the tube bundle 24 and into the combustion chamber 26. Although shown as cylindrical tubes, the cross-section of the premixer tubes 30 may be any geometric shape, and the present invention is not limited to any particular cross-section unless specifically recited in the claims. The outer shroud 31 circumferentially surrounds at least a portion of the tube bundle 24 to partially define a fuel plenum 50 and a diluent plenum 52 between the upstream and downstream surfaces 42, 44. A generally horizontal barrier 54 may extend radially between the upstream surface 42 and the downstream surface 44 to axially separate the fuel plenum 50 from the diluent plenum 52. In this manner, the upstream surface 42, outer shroud 31, and barrier 54 enclose or define the fuel plenum 50 around the upstream portion of the premixer tubes 30, and the downstream surface 44, outer shroud 31, and barrier 54 enclose or define the diluent plenum 52 around the downstream portion of the premixer tubes 30.

A fuel supply 56 and a diluent supply 58 may extend through the end cover 14 and through the upstream surface 42 to provide fluid communication for fuel and diluent to flow through the end cover 14 to the respective fuel or diluent plenums 50, 52 in each tube bundle 24. The fuel supplied to the tube bundle 24 may include any liquid or gaseous fuel suitable for combustion, and possible diluents supplied to the tube bundle 24 may include water, steam, fuel additives, various inert gases such as nitrogen and/or various non-flammable gases such as carbon dioxide or combustion exhaust gases. In the particular embodiment shown in FIG. 6, the fuel supply 56 is substantially concentric with the diluent supply 58, although such is not a limitation of the present invention unless specifically recited in the claims.

One or more of the premixer tubes 30 may include a fuel port 60 that provides fluid communication from the fuel plenum 50 into the one or more premixer tubes 30. The fuel ports 60 may be angled radially, axially, and/or azimuthally to project and/or impart swirl to the fuel flowing through the fuel ports 60 and into the premixer tubes 30. In this manner, the working fluid 15 may flow through the tube inlets 46 and into the premixer tubes 30, and fuel from the fuel plenum 50 may flow through the fuel ports 60 and into the premixer tubes 30 to mix with the working fluid 15. The fuel-working fluid mixture may then flow through the premixer tubes 30 and into the combustion chamber 26.

The diluent may flow from the diluent supply 58 around the premixer tubes 30 in the diluent plenum 52 to provide convective cooling to the premixer tubes 30 and/or impingement cooling to the downstream surface 44. The diluent may then flow through the diluent ports 34 and/or diluent distributors 32 and into the combustion chamber 26. In this manner, the diluent may form a fluid barrier between adjacent tube bundles 24 to separate the combustion flames of adjacent tube bundles 24, thereby reducing or preventing any interaction between the combustion flames of adjacent tube bundles 24.

As shown in FIG. 6, each diluent distributor 32 generally extends downstream from the downstream surface 44 of the end cap 28 and into the combustion chamber 26. The diluent distributors 32 provide a physical barrier between adjacent tube bundles 24 and may include a plurality of diluent injectors 66 that project the diluent into the combustion chamber 26 between adjacent tube bundles 24. The diluent flowing through the diluent distributors 32 provides convective and/or film cooling to the diluent distributors 32. Alternately or in addition, a thermal barrier coating 68 on the downstream surface of the diluent distributors 32 may protect the diluent distributors 32 from excessive thermal loading and/or oxidation associated with the combustion flame. In particular embodiments, the thermal barrier coating 68 may include a plurality of layers that include at least a metallic bond coating, a thermally prepared oxide, and/or a ceramic top coating, although the particular composition and structure of the thermal barrier coating 68 is not a limitation of the present invention unless specifically recited in the claims.

Figure 7:
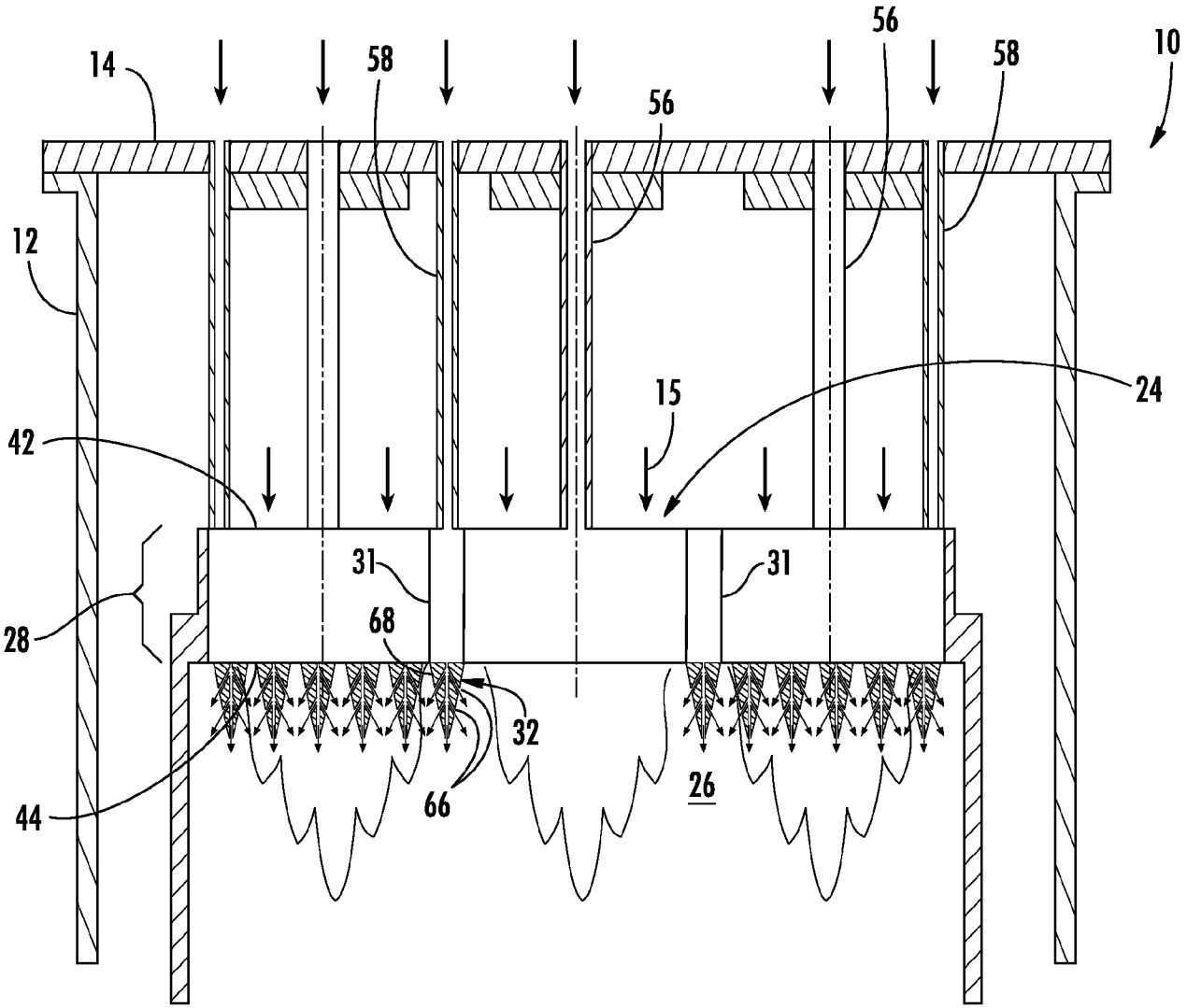
FIG. 7 is an enlarged cross-section view of a portion of the combustor shown in FIGS. 1 and 4 according to an alternate embodiment of the present invention.
Figure 8:
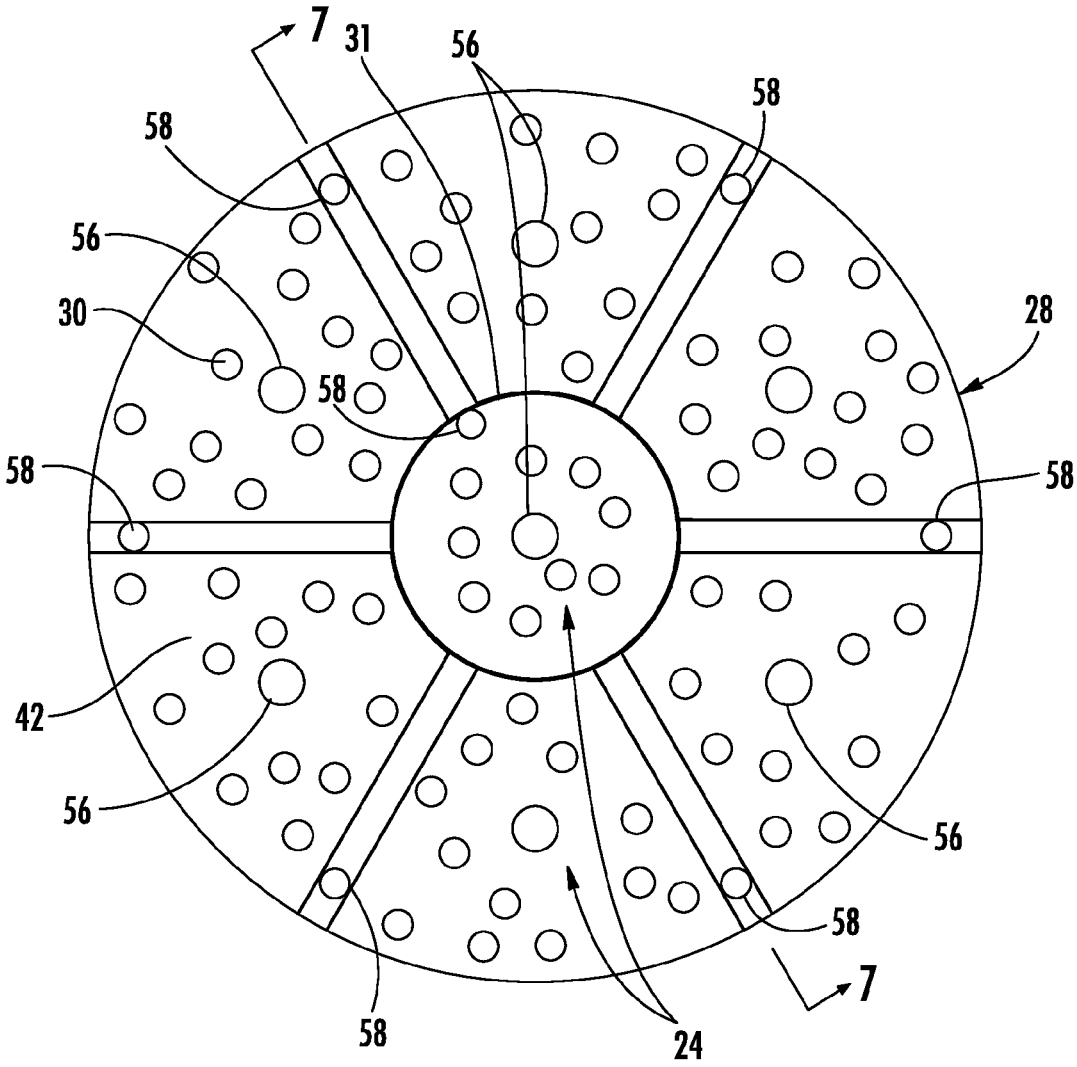
FIG. 8 is a downstream axial view of the end cap shown in FIG. 7.

FIG. 7 provides an enlarged cross-section view of a portion of the combustor 10 shown in FIGS. 1 and 4 according to an alternate embodiment of the present invention, and FIG. 8 provides a downstream axial view of the end cap 28 shown in FIG. 7. As shown, the end cap 28 generally extends radially across at least a portion of the combustor 10 and includes the upstream and downstream surfaces 42, 44 previously described with respect to the tube bundle 24 shown in FIG. 6. As shown in FIG. 7, one or more tube bundles 24 extend from the upstream surface 42 through the downstream surface 44 to provide fluid communication for fuel and/or working fluid 15 through the end cap 28. As additionally shown in FIGS. 7 and 8, the fuel supply 56 is in fluid communication with the tube bundles 24, and the diluent supply 58 is in fluid communication with the diluent distributors 32. The dividers 36 extend axially through at least a portion of the end cap 28 and through the downstream surface 44 to separate one or more pairs of adjacent tube bundles 24. In this manner, the diluent supply 58 may supply diluent to and through the diluent distributors 32 and into the combustion chamber 26 between the adjacent tube bundles 24.

The various embodiments described and illustrated with respect to FIGS. 1-8 may also provide a method for reducing combustion dynamics in the combustor 10. The method may include flowing the fuel through one or more tube bundles 24 that extend axially through the end cap 28 that extends radially across at least a portion of the combustor 10. The method may further include flowing the diluent through one or more diluent distributors 32 inside and/or between one or more tube bundles 24 into the combustion chamber 26 downstream from the end cap 28, wherein the diluent distributors 32 are circumferentially arranged inside at least one tube bundle 24 and each diluent distributor 32 extends downstream from the end cap 28. In this manner, the method may form a diluent barrier in the combustion chamber 26 between at least one pair of adjacent tube bundles 24.

In particular embodiments, the method may form the diluent barrier completely around one or more tube bundles 24 and/or between each pair of adjacent tube bundles 24. In still further embodiments, the method may inject the diluent into the combustion chamber 26 downstream from the end cap 28 and/or flow the fuel concentrically with the diluent through at least a portion of the combustor 10.

The systems and methods described herein may provide one or more of the following advantages over existing nozzles and combustors. For example, the diluent barrier created by the diluent distributors 32 and/or diluent ports 34 decouple flame interaction between the adjacent tube bundles 24 and thus reduce the combustion dynamics in the combustor 10. The reduced combustion dynamics in the combustor 10 may extend the operating capability of the combustor 10 over a wide range of fuels without decreasing the useful life and/or maintenance intervals for various combustor 10 components. Alternately, or in addition, the reduced combustion dynamics may maintain or increase the design margin against flashback or flame holding and/or reduce undesirable emissions over a wide range of combustor 10 operating levels.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A system for reducing combustion dynamics in a combustor, comprising:
   a. an end cap that extends radially across at least a portion of the combustor, wherein the end cap comprises an upstream surface axially separated from a downstream surface;
   b. a plurality of premixing tube bundles that extends from the upstream surface through the downstream surface of the end cap, wherein each premixing tube bundle provides fluid communication through the end cap for providing fuel and air to the combustor;
   c. a diluent supply source in fluid communication with the end cap, wherein the diluent supply source provides diluent flow to the end cap; and
   d. a plurality of first diluent distributors circumferentially arranged inside at least one tube bundle, wherein each first diluent distributor extends downstream from the downstream surface and provides fluid communication for the diluent flow through the downstream surface of the end cap.

2. The system as in claim 1, further comprising a plurality of diluent ports circumferentially arranged around more than one tube bundle, wherein the diluent ports provide fluid communication for the diluent flow through the downstream surface of the end cap.

3. The system as in claim 1, wherein each first diluent distributor comprises a plurality of injectors that provides fluid communication through the first diluent distributor.

4. The system as in claim 1, further comprising a thermal barrier coating on each first diluent distributor.

5. The system as in claim 1, further comprising a divider between at least one pair of adjacent tube bundles, wherein the divider defines a diluent passage that extends axially through the downstream surface.

6. The system as in claim 5, further comprising a plurality of second diluent distributors in fluid communication with the diluent passage defined by the divider, wherein each second diluent distributor extends downstream from the downstream surface and provides fluid communication for the diluent flow through the downstream surface of the end cap.

7. The system as in claim 1, further comprising a fuel supply in fluid communication with each tube bundle, wherein the fuel supply is substantially concentric with the diluent supply.

8. A system for reducing combustion dynamics in a combustor, comprising:
   a. an end cap that extends radially across at least a portion of the combustor, wherein the end cap comprises an upstream surface axially separated from a downstream surface;
   b. a plurality of premixing tube bundles that extends from the upstream surface through the downstream surface of the end cap, wherein each tube bundle provides fluid communication through the end cap for providing fuel and air to the combustor;
   c. a diluent supply source in fluid communication with the end cap, wherein the diluent supply provides diluent flow to the end cap;
   d. a plurality of diluent ports circumferentially arranged inside at least one tube bundle, wherein the plurality of diluent ports provides fluid communication for the diluent flow through the downstream surface of the end cap; and
   e. a plurality of first diluent distributors in fluid communication with at least some of the diluent ports, wherein each first diluent distributor extends downstream from the downstream surface.

9. The system as in claim 8, wherein the diluent ports are circumferentially arranged around more than one tube bundle.

10. The system as in claim 8, wherein the plurality of first diluent distributors are in fluid communication with each diluent port.

11. The system as in claim 8, wherein each first diluent distributor comprises a plurality of injectors that provide fluid communication through the first diluent distributor.

12. The system as in claim 8, further comprising a thermal barrier coating on each first diluent distributor.

13. The system as in claim 8, further comprising a divider between at least one pair of adjacent tube bundles, wherein the divider defines a diluent passage that extends axially through the downstream surface.

14. The system as in claim 13, further comprising a plurality of second diluent distributors in fluid communication with the diluent passage defined by the divider, wherein each second diluent distributor extends downstream from the downstream surface and provides fluid communication for the diluent flow through the downstream surface of the end cap.

15. The system as in claim 8, further comprising a fuel supply in fluid communication with each tube bundle, wherein the fuel supply is substantially concentric with the diluent supply.

16. A method for reducing combustion dynamics in a combustor, comprising:

a. flowing a fuel and air through a plurality of premixing tube bundles that extend axially through an end cap that extends radially across at least a portion of the combustor;

b. flowing a diluent through a plurality of diluent distributors into a combustion chamber downstream from the end cap, wherein the plurality of diluent distributors are circumferentially arranged inside at least one tube bundle and each diluent distributor extends downstream from the end cap; and c. forming a diluent barrier in the combustion chamber between at least one pair of adjacent tube bundles.

17. The method as in claim 16, further comprising forming the diluent barrier around the first tube bundle.

18. The method as in claim 16, further comprising forming the diluent barrier between each pair of adjacent tube bundles.

19. The method as in claim 16, further comprising injecting the diluent into the combustion chamber downstream from the end cap.

20. The method as in claim 16, further comprising flowing the fuel concentrically with the diluent through at least a portion of the combustor.

* * * * *